US005551557A

United States Patent [19]

Brooks et al.

[11] Patent Number: 5,551,557

[45] Date of Patent: Sep. 3, 1996

[54] EFFICIENT METHOD AND APPARATUS FOR ESTABLISHING SHELF-LIFE OF GETTERS UTILIZED WITHIN SEALED ENCLOSURES

[75] Inventors: Ray G. Brooks, Irving, Tex.; Charles J. Corris, Elkmont, Ala.

[73] Assignee: Convey, Inc., Irving, Tex.

[21] Appl. No.: 328,368

[22] Filed: Oct. 25, 1994

[51] Int. Cl.[6] ..... B65D 81/24; B65D 81/26

[52] U.S. Cl. ..... 206/205; 206/204; 206/524.1; 206/497; 206/484.1

[58] Field of Search ..... 206/205, 209, 206/524.1, 524.2, 497, 484.1; 96/147, 138, 151; 53/410, 428

[56] References Cited

U.S. PATENT DOCUMENTS

| | | | |
|---|---|---|---|
| 1,050,706 | 1/1913 | Taylor . | |
| 2,446,361 | 7/1945 | Clibbon | 312/31.1 |
| 2,536,274 | 1/1951 | Gaugler | 210/131 |
| 2,548,780 | 4/1951 | Gary et al. | 23/186 |
| 2,638,179 | 5/1953 | Yard | 183/4.8 |
| 2,728,407 | 12/1955 | Squier | 183/4.8 |
| 2,994,404 | 8/1961 | Schifferly | 183/4.8 |
| 3,128,135 | 4/1964 | Ege | 312/31 |
| 3,291,374 | 12/1966 | Lepisto et al. | 229/55 |
| 3,323,640 | 6/1967 | Kugler | 206/47 |
| 3,516,567 | 6/1970 | Hemphill | 220/14 |
| 3,638,784 | 2/1972 | Bodolay et al. | 206/45.34 |
| 3,722,188 | 3/1973 | Cullen | 55/384 |
| 3,820,309 | 6/1974 | Cullin | 55/387 |
| 3,939,971 | 2/1976 | Tulis | 206/205 |
| 3,942,634 | 3/1976 | Gandi et al. | 206/210 |
| 4,137,049 | 1/1979 | Couch et al. | 422/56 |
| 4,154,344 | 5/1979 | Yenni, Jr. et al. | 206/524.6 |
| 4,235,233 | 11/1980 | Mouwen | 128/214 |
| 4,579,223 | 4/1986 | Otsuka et al. | 206/204 |
| 4,657,133 | 4/1987 | Komatsu et al. | 206/204 |
| 4,667,814 | 5/1987 | Wakamatsu et al. | 206/0.7 |
| 4,776,455 | 10/1988 | Anderson | 206/0.5 |
| 4,820,297 | 4/1989 | Kaufman et al. | 604/409 |
| 4,997,083 | 3/1991 | Loretti et al. | 206/219 |
| 4,999,034 | 3/1991 | Mager et al. | 55/275 |
| 5,040,678 | 8/1991 | Lenmark | 206/443 |
| 5,095,626 | 3/1992 | Kitamura | 29/827 |
| 5,228,567 | 7/1993 | Itoh | 206/328 |
| 5,241,149 | 8/1993 | Watanabe et al. | 206/204 X |
| 5,295,297 | 3/1994 | Kitamura et al. | 29/827 |
| 5,445,965 | 8/1995 | Stone | 436/81 |

*Primary Examiner*—Paul T. Sewell
*Assistant Examiner*—Tara Laster
*Attorney, Agent, or Firm*—Geoffrey A. Mantooth

[57] ABSTRACT

A method for establishing a shelf life for getters is provided. The getter absorbs one or more gasses. One type of getter that can be used is desiccant to absorb moisture. The getter is sealed in a container that is impervious to the gas that is to be absorbed by the getter. The gas impervious container is placed within a gas previous first enclosure, which is positioned in a sealable second enclosure. A gas sensitive article is also located within the sealable enclosure. The sealable enclosure is sealed about the first enclosure and the article. The getter is activated to absorb any gas within the sealed enclosure by rupturing the container through the first and second enclosures. The second container retains the ruptured first container and the exposed getter.

11 Claims, 4 Drawing Sheets

EFFICIENT METHOD AND APPARATUS FOR ESTABLISHING SHELF-LIFE OF GETTERS UTILIZED WITHIN SEALED ENCLOSURES

FIELD OF THE INVENTION

The present invention relates to a method and apparatus of storing articles in sealed enclosures in conjunction with chemicals having limited shelf lives, such as a method of storing articles in a moisture-free enclosure containing getter agents.

DESCRIPTION OF THE RELATED ART

In many fields of manufacturing, there are requirements for getters which protect articles from damage due to chemicals. A getter stays in one location and absorbs a targeted chemical or chemicals, which are typically in gaseous form. By absorbing the harmful chemicals, damage to an article by the chemical is prevented.

One example of common getters are desiccants, which protect moisture sensitive articles from moisture damage within sealable enclosures such as plastic bags, tins, or other containers. The desiccants absorb moisture and are used to protect articles from the damaging effects of moisture (which can cause, for example, corrosion of component parts).

Ideally, in order to maximize the effectiveness of the getter, the getter must be fresh and unexposed to the targeted chemical prior to location within the enclosure.

However, present getter packaging methods expose the getters to the targeted chemical prior to packaging, thereby reducing the amount of time that the getter can maintain the package in a targeted chemical-free condition. Getters are typically stored in bulk in an air tight container. The container is opened to provide access to the getter each time the getter is needed. Each time the air tight container is opened, the getter is exposed to and absorbs the targeted chemical (for example atmospheric moisture), reducing the ultimate effectiveness of the getter. Expensive vacuum processing equipment may be used to reduce exposure during handling but absorption of the targeted chemical from the atmosphere may still occur prior to vacuum sealing the air tight container.

Exposure of the getter to the targeted chemical prior to its placement in a sealed enclosure with an article reduces the length of time that the article may be stored in the enclosure free of the targeted chemical. A specific quantity of getter can absorb only a limited maximum amount of the targeted chemical. The shelf life (relating to the exposure to the targeted chemical) of the article is thus dependant on the shelf life of the getter. Exposure of the getter to the targeted chemical prior to location within the sealed enclosure reduces the amount of the targeted chemical the getter can absorb from within the enclosure, thereby reducing the shelf life of the article.

Exposure of the getter to the targeted chemical prior to placement in a sealed enclosure with a sensitive article also renders calculation of a shelf life impossible. A shelf life for an article within the enclosure may be calculated from the quantity of getter, a projected rate of exposure of the contents within the sealed enclosure to the targeted chemical, and the time of initial exposure ("start time") of the getter to the targeted chemical. Exposure of the getter to the targeted chemical prior to location within the sealed enclosure renders the "start time" indefinite and the amount of the targeted chemical already absorbed by the getter unknown. The shelf-life, therefore, cannot be calculated with any certainty since the "start time" and the amount of the targeted chemical absorbed by the getter are unknown.

SUMMARY OF THE INVENTION

Therefore, it is an object of the invention to provide a method for packaging a getter to enable the getter to be activated to absorb a targeted chemical at a selected time.

It is a further object of the invention to provide a method for packaging a getter which enables a shelf life to be determined for the getter.

It is a still further objective of the invention to provide a method for protecting an article from gas within a sealed enclosure.

In one aspect of the invention, a method for establishing a shelf life of a getter is provided. The getter is provided in a container that is impervious to the gas that the getter is to absorb. The container is positioned within an interior of a sealable enclosure, and then the enclosure is sealed about the container. The container is ruptured to expose the getter to any of the gas within the enclosure.

In a further aspect of the invention, a method of protecting an article in a sealed enclosure is provided. A getter is provided within a first container. The first container is impervious to the gas that the getter is to absorb. A second container that is pervious to the gas is provided, wherein the first container is located within the second container. The getter, the first container, and the second container are positioned within the enclosure. The article is also positioned within the enclosure. The enclosure is sealed about the first container, second container, and the article. The first container is ruptured through the second container and the enclosure to expose the getter to any gas within the enclosure.

DESCRIPTION OF THE PREFERRED EMBODIMENTS

The present invention utilizes getters that absorb target chemicals that are typically in gaseous form. Getters are typically used to remove one or more gasses from a controlled or sealed volume of space. One common type of getter is a desiccant, which is used to absorb moisture.

Figure 1:
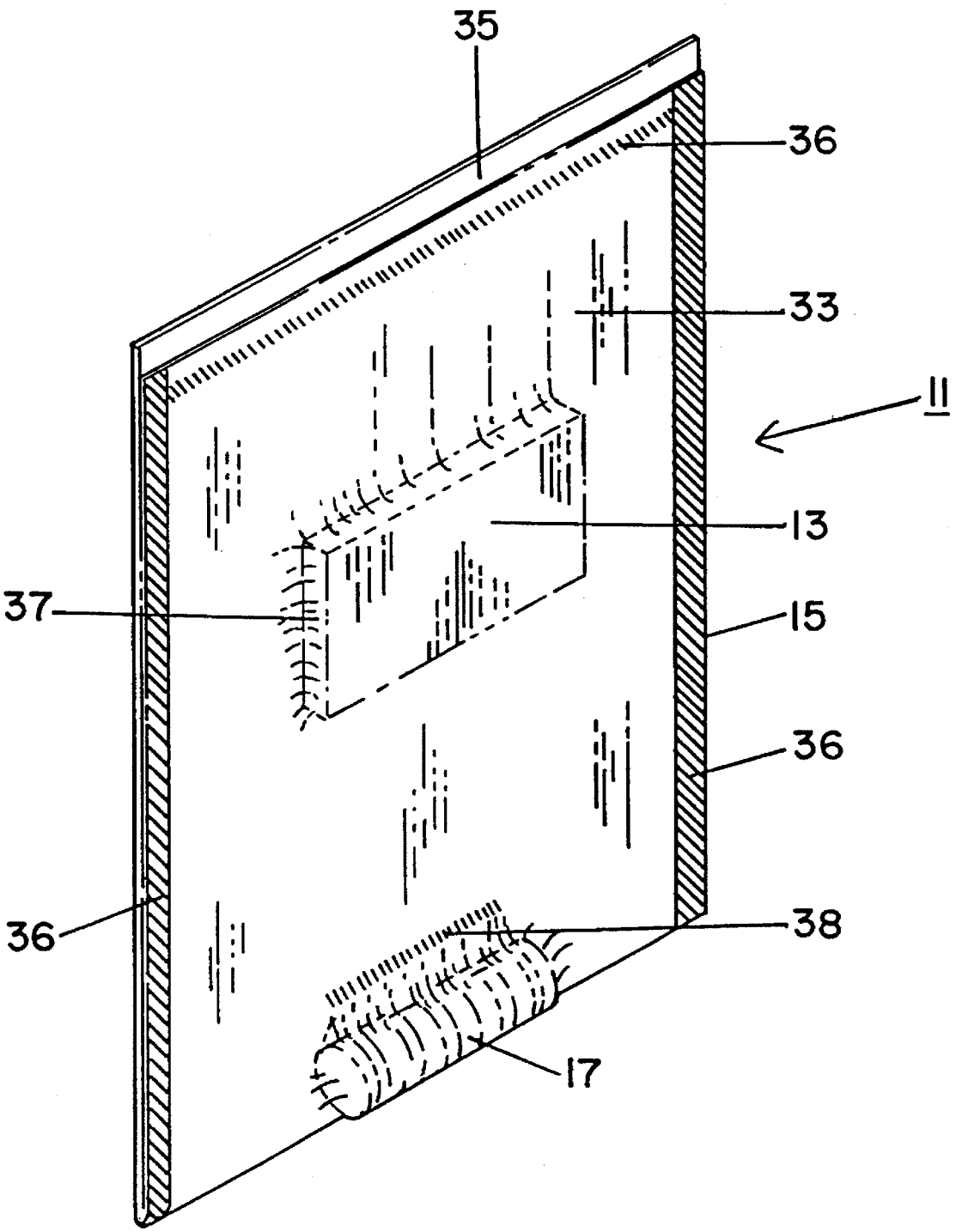
FIG. 1 is an isometric view of the enclosure of the present invention with an article and a getter pouch located within the enclosure.
Figure 2:
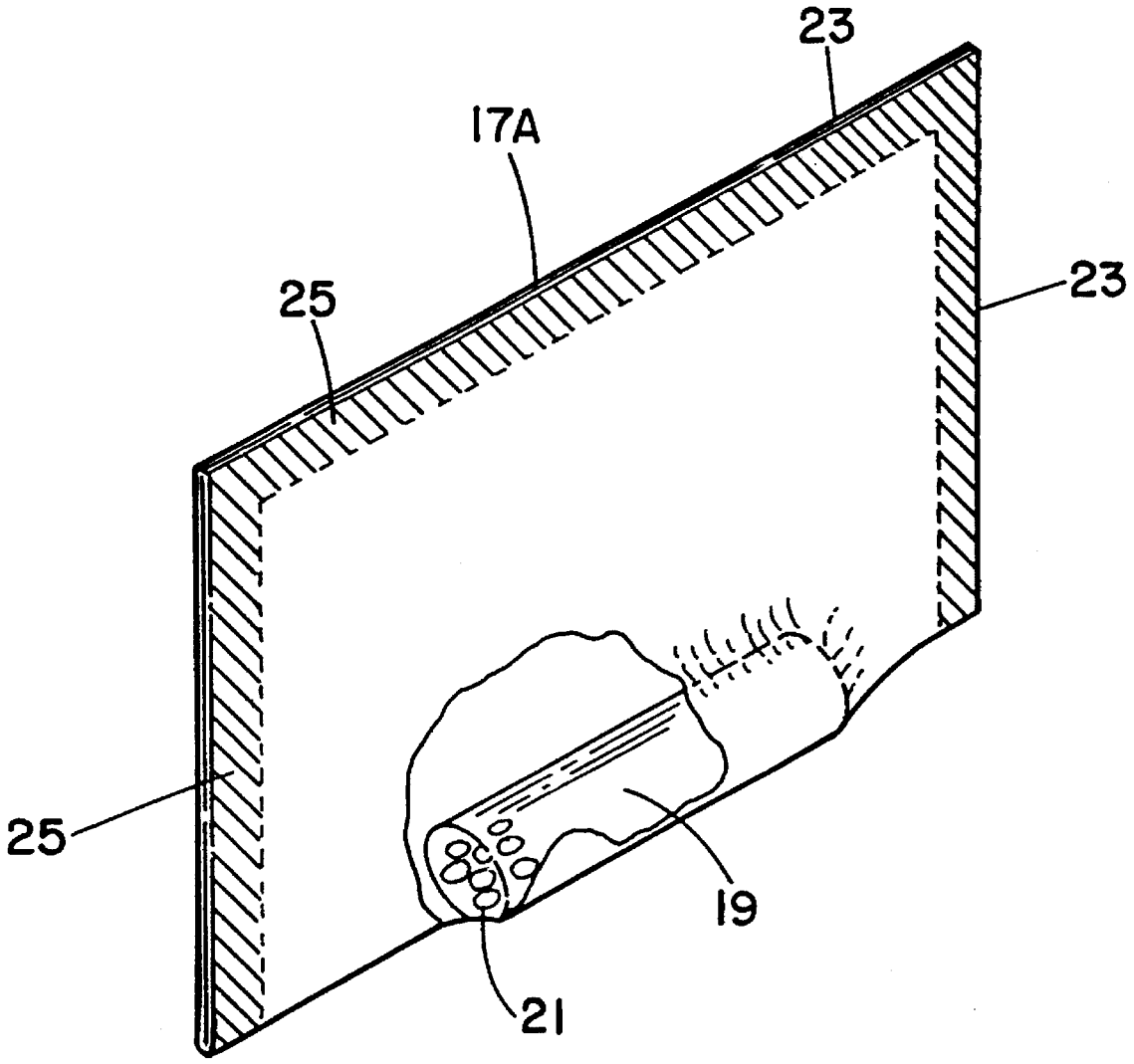
FIG. 2 is an isometric view of a first embodiment of the getter pouch having a portion of the getter pouch cut away to show the interior of the pouch.

Referring now to FIG. 1, there is shown a sealable enclosure or envelope 11. A gas sensitive article 13 is located in the sealable enclosure 11 along with a gas permeable getter pouch 17. There are disclosed herein several embodiments of the getter pouch 17. For example, there is shown in FIG. 2 one embodiment of the getter pouch 17A. The pouch 17A is sealed about a gas impervious sealed ampoule 19 which contains a getter 21.

Referring again to FIG. 1, the article 13 is sealed in the enclosure 11 along with the getter pouch 17 and is maintained in a gas free environment by rupturing the ampoule 19 at a selected time to expose the getter 21 within the ampoule to any gas within the enclosure 11.

According to the method of the present invention, the getter 21 is maintained in a gas free atmosphere within the ampoule 19 until a selected time for activation, typically just prior to or just after sealing the article 13 within the enclosure 11. Upon activation by rupturing the ampoule 19, the getter 21 is released from the gas free atmosphere of the ampoule 19 and is exposed to absorb any gas in the enclosure 11. The getter pouch 17 that contains the ampoule retains the getter 21 and the ruptured ampoule 19 while allowing gas to pass through the pouch 17 to be absorbed by the getter 21.

A gas-free shelf life for the article 13 within the enclosure 11 can be determined from the time of activation of the getter since initial exposure of the getter to gas occurs upon rupturing the ampoule. The time of activation provides a starting time for measuring the useful life of the getter and, therefore, the gas-free shelf life of the article 13. The condition of the gas sensitive article 13 within the enclosure 11 can be evaluated by ascertaining whether the determined useful life of the getter has been exceeded.

Referring now to FIG. 2, preparation of the getter 21 and its gas-proof ampoule 19 for use in the getter pouch 17 will be described. The getter 21 in the ampoule 19 may be any of several conventional desiccants including calcium oxide and calcium chloride which readily absorb atmospheric moisture. In one embodiment, calcium oxide desiccant may be prepared according to the method disclosed in Wright et al., U.S. Pat. No. 2,548,780, which is incorporated herein by reference. Another type of getter is finely powdered copper that is used to absorb oxygen. Still another type of getter is barium.

The ampoule 19 may be any conventional container that is non-permeable to the particular gas or chemical that is absorbed by the getter and that may be ruptured or broken relatively easily. The ampoule 19 may be formed of glass or thin walled metal. In a preferred embodiment, the ampoule 19 is formed by a glass capsule sealed about the getter 21.

The getter 21 must be previously unexposed to the particular gas or gasses that it absorbs when the getter is sealed within the gas proof ampoule 19. The ampoule 19 is filled with the getter 21 and sealed under conditions which do not expose the getter to the particular gas. Conventional methods of providing a gas free atmosphere may be used to provide a gas-free atmosphere about the getter 21 and the ampoule 19 while the ampoule 19 is filled with and sealed about the getter 21. Ampoules 19 of different sizes may be used and the amounts of getter placed in the ampoules may vary according to the amount of gas to be absorbed or the desired shelf life to be provided by the getter.

After the getter 21 is sealed within the ampoule 19, the ampoule 19 is secured within the getter pouch 17A The getter pouch 17A is formed to permit the ampoule 19 to be ruptured or broken within the pouch 17A while the structural integrity of the pouch 17A is maintained. Rupturing or breaking the ampoule 19 exposes the getter 21 to gas. The pouch 17A retains the ruptured or broken ampoule 19 and the exposed getter 21 after the getter is activated, thereby protecting the article 13 from pieces of the broken or ruptured ampoule and from the exposed getter. The pouch 17A is gas permeable (or otherwise permeable to the chemical that is absorbed by the getter) so that the gas may enter the pouch 17A and be absorbed by the activated getter 21.

In FIG. 2, a preferred embodiment of the getter pouch 17A is shown. The getter pouch 17A is comprised of paper such as crepe paper or filter paper. In order to form the pouch 17A, the ampoule 19 is centered on a sheet of paper and the paper is folded about the ampoule 19. The edges 23 of the paper are secured together to enclose the ampoule 19 within the paper. In one embodiment, adhesive strips 25 are located extending along the edges 23 of the paper so that the edges may be adhered together by removing an adhesive backing from the adhesive strips and pressing the edges together. In another embodiment, glue is applied to the edges 23 and the edges are pressed together to adhere the edges about the ampoule.

Figure 3:
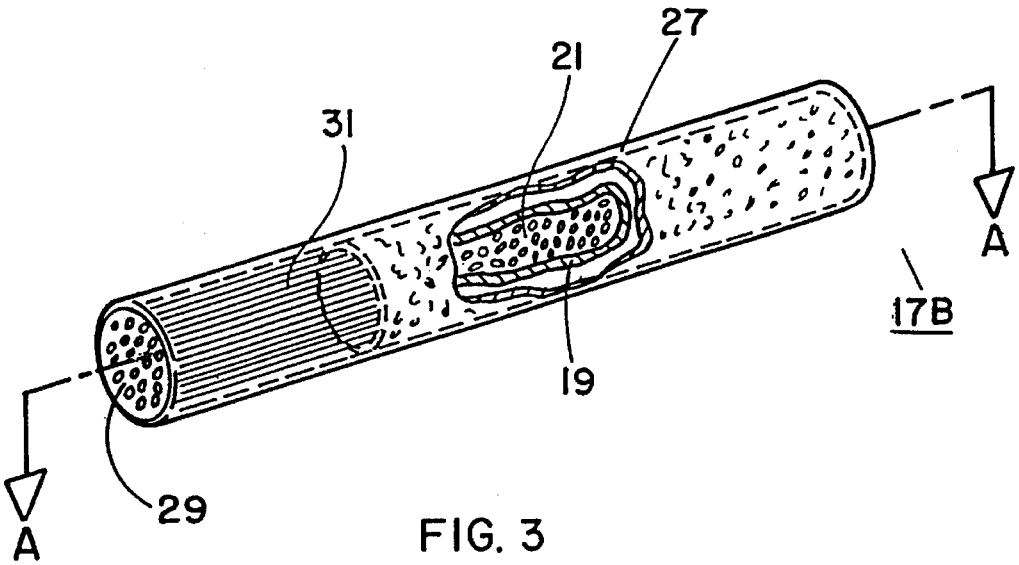
FIG. 3 is a perspective view of a second embodiment of the getter pouch having a cutaway portion showing the interior of the pouch.
Figure 4:
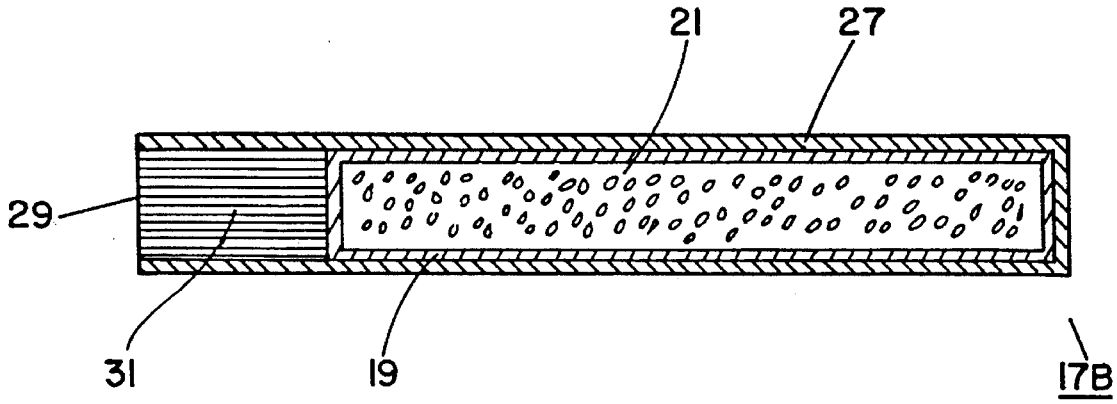
FIG. 4 is a cross sectional view of the second embodiment of the getter pouch as seen along lines A—A in FIG. 3.

Referring now to FIGS. 3–4, another embodiment of the getter pouch 17B is shown. The pouch 17B is comprised of a plastic container 27 having an open end 29 which communicates with a cavity located within the container. The container 27 receives and retains the ampoule 19 in the cavity through the open end 29 of the container. A gas permeable filter 31 is located in the open end 29 of the container 27 extending across the open end 29 to hold the ampoule 19 within the container and to allow gas to enter the container. The plastic material which forms the container 27 is flexible so the ampoule 19 located within the container may be ruptured by force directed against the container. The filter 31 can be wadded crepe or filter paper.

Figure 5:
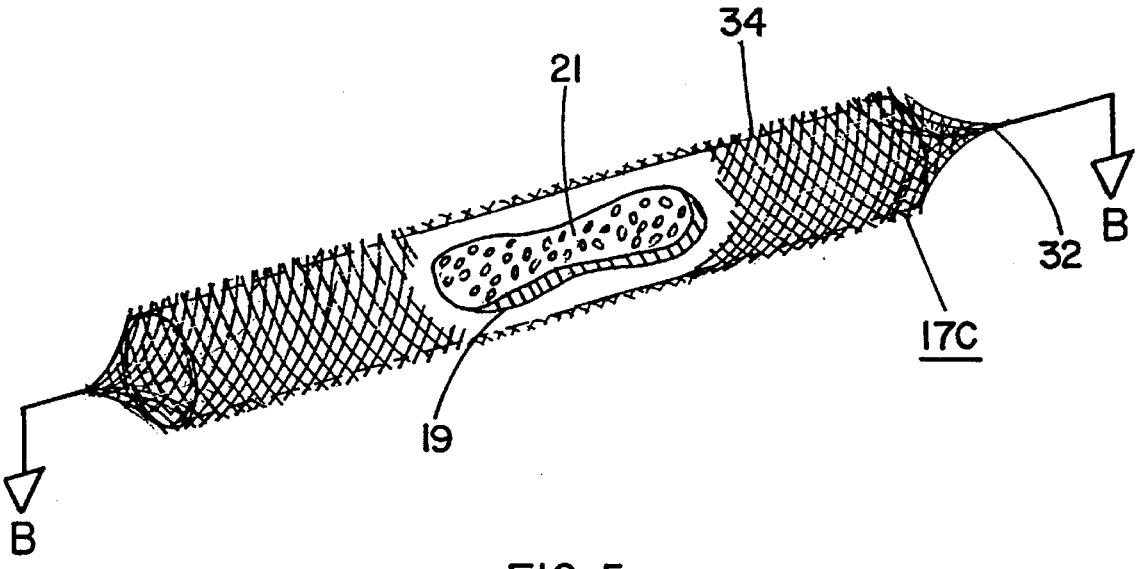
FIG. 5 is a perspective view of a third embodiment of the getter pouch having a cutaway portion showing the interior of the pouch.
Figure 6:
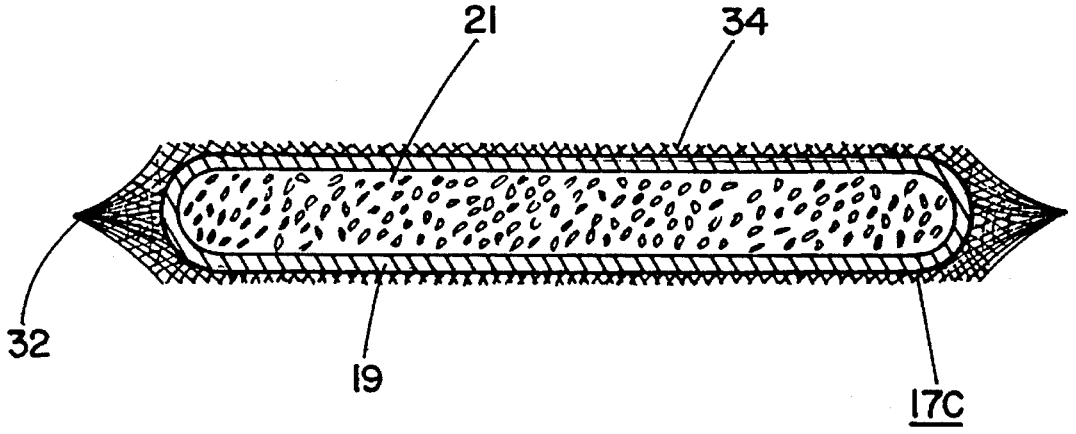
FIG. 6 is a cross sectional view of the third embodiment of the getter pouch as seen along line B—B in FIG. 5.

Referring to FIGS. 5–6, another embodiment of the getter pouch 17C is shown. The getter pouch 17C is comprised of a gas permeable cloth 34 secured about the ampoule 19. To form the cloth getter pouch 17C the ampoule 19 is placed on a sheet of cloth material and the cloth material is wrapped about the ampoule. The cloth material is secured about the ampoule 19 by conventional means, being secured by adhesive or by being sewn together about the ampoule. The ends 32 of the cloth material are crimped together to secure the ampoule with the material. In FIGS. 5–6 the weave of the cloth material is shown much larger than the actual weave of the cloth for illustrative purposes. In actuality, the weave of the cloth is smaller than the size of the getter particles so that the getter particles and the ruptured pieces of the ampoule are retained within the pouch 17C when freed from the ampoule.

As shown in FIG. I, the getter pouch 17 is placed within the enclosure 11 together with the gas sensitive article 13. The enclosure 11 is formed of a sealable, relatively gas impervious material. The enclosure 11 is sufficiently flexible to permit rupturing force to be applied to the ampoule 19 in the getter pouch 17 through the enclosure while maintaining the structural integrity of the enclosure. In a preferred embodiment, the enclosure 11 may be constructed of material designed to protect electronic components from electrostatic charges such as that disclosed by Yenni Jr et al., U.S. Pat. No. 4,154,344, which is incorporated herein by reference.

The enclosure 11 has walls 33 having an opening 35 extending through at least one of the walls 33 communicating with a cavity 37 disposed between the walls. Referring to FIGS. 1–2, in a preferred embodiment, the creation of a gas-free environment for a gas sensitive article with freshly activated getter in the enclosure 11 is straightforward. A preprepared getter pouch 17 is selected containing an appropriate amount of getter required to absorb the unwanted type of gas from within the enclosure 11 for a selected period of time. The getter pouch 17 and the gas sensitive article 13 are placed into the cavity 37 through the opening 35. The opening 35 is sealed along the strip 36 after the article 13 and the getter pouch 17 are located in the cavity 37 to secure the article 13 and the getter pouch 17 in an enclosed environment. The sides of the enclosure are also sealed along the strip. The bottom edge of the enclosure may be sealed. Alternatively, the bottom edge is formed by folding the wall 33 over itself so as to form the enclosure. Thus, a seal along the bottom edge is formed by the fold. The sides are then sealed. If desired, a vacuum may be drawn on the enclosure 11 prior to sealing to remove most gas from the cavity. In a preferred embodiment, the enclosure 11 is formed of a plastic material such as polyethylene that may be sealed by application of heat to the wall sides. In addition, a heat seal 38 may be applied near the getter pouch 17 retain the pouch near a side of the enclosure and away from the article.

The getter 21 is activated to absorb gas in the sealed enclosure by applying rupturing force through the walls 33 to the ampoule 19 within the getter pouch 17, which ruptures to expose the getter 21 to gas. For example, a human hand can be used to crush the ampoule. Alternatively, a soft hammer can be used to hit and crush the ampoule. The unwanted gas (such as moisture) is absorbed by the getter 21 over the useful lifespan of the getter through the gas permeable getter pouch 17 until the getter is spent by becoming saturated with gas. Thus, the getter 21 is retained by the pouch 17. The targeted chemical enters the permeable pouch 17 and is absorbed by the getter.

The getter 21 may be activated at any desired time by rupturing the ampoule 19. Typically the getter 21 will be activated just prior to sealing the enclosure 11 or just after sealing the enclosure, however, activation is not limited to the time of sealing. For example, the sealed enclosure 11 may well be stored in a safe environment for a long period of time during which the getter is left unactivated. The getter may then be activated when the enclosure 11 is located in an environment that contains the target chemical designed to be absorbed by the getter.

Once the ampoule 19 is ruptured, and the getter is activated, a shelf life can be determined for the getter and also for the article that is being protected by the getter. Shelf life is determined in accordance with conventional techniques. For example, the following factors are considered when determining shelf life: the quantity of getter, a projected rate of exposure of the getter to the targeted chemical (or the estimated quantity of the targeted chemical within the sealed enclosure), and the time of initial exposure of the getter to the targeted chemical. The present invention allows the initial time of exposure of the getter to be determined with accuracy, thereby enabling a more accurate determination of shelf life.

As a result of the unique construction of the invention, access to the getter 21 in the sealed enclosure 11 for activation is not necessary. Getter activation is accomplished at any time after sealing of the enclosure 11 by simply applying pressure on the enclosure externally against the ampoule 19. Thus, the ampoule 19 is rupturable at any selected time after sealing so as to extend the useful life of the getter to the maximum.

The foregoing disclosure and the showings made in the drawings are merely illustrative of the principles of this invention and are not to be interpreted in a limiting sense. For example, a getter pouch need not be included in the enclosure since placement of a gas proof ampoule containing the getter within the enclosure is sufficient to provide a gas free environment with a user selected activation time.

We claim:

1. A method for establishing a shelf life of a getter, said getter being used to absorb a gas, comprising the steps of:

a) providing said getter in a container that is impervious to said gas;

b) positioning said container within an interior of a sealable enclosure;

c) sealing said enclosure; and d) rupturing said container in said sealed enclosure to expose said getter to any of said gas within said enclosure, wherein a start time of said getter can be determined.

2. The method of claim 1 wherein said step of rupturing said container to expose said getter to any of said gas within said enclosure further comprises the step of crushing said container.

3. The method of claim 1 further comprising the step of drawing a vacuum on said enclosure interior before sealing said enclosure.

4. A method for protecting an article within a sealed enclosure with a getter that absorbs a gas, comprising the steps of:

a) providing said getter within a first container that is impervious to said gas and providing said first container within a second container that is pervious to said gas;

b) positioning said getter and said first and second containers within said enclosure;

c) positioning said article within said enclosure;

d) sealing said enclosure;

e) rupturing said first container through said second container and said sealed enclosure while maintaining said enclosure in an unruptured condition so as to expose said getter to any of said gas within said enclosure.

5. The method of claim 4 further comprising the step of, after said first container is ruptured, retaining said getter within said second container.

6. An apparatus for storing articles, comprising:

a) a getter located within a container, said getter absorbing a gas, said container being impervious to said gas when said container is unruptured;

b) a first enclosure that is permeable to said gas, said container being located in said first enclosure, said first enclosure retaining said container in said getter when said container is ruptured;

c) a second enclosure that is sealable and that is structured and arranged to contain an article, said first enclosure being located in said second enclosure.

7. The apparatus of claim 6 wherein said second enclosure is made of plastic.

8. The apparatus of claim 6 wherein said container is made of glass.

9. The apparatus of claim 6 wherein said enclosure is made of paper.

10. The apparatus of claim 6 wherein said enclosure is made of cloth.

11. Am apparatus for absorbing a gas, comprising:

a) a getter located within a first container, said getter absorbing said gas, said first container being impervious to said gas when said first container is unruptured;

b) a second container that is deformable without rapturing, said second container having a cavity therein and an opening that allows communication between said cavity and an exterior of said second container;

c) said first container being located in said cavity of said second container;

d) a filter, said filter being located in said opening, said filter being permeable to said gas.

* * * * *